US005722209A

United States Patent [19]

Delaney et al.

[11] Patent Number: 5,722,209

[45] Date of Patent: Mar. 3, 1998

[54] PROCESS FOR CUTTING OUT DECORATIVE/ARTISTIC DESIGNS AND PRODUCTS PRODUCED THEREBY

[75] Inventors: Peter C. Delaney, 30 School St., Keene, N.H. 03431; Ronald C. Goodnow, Fitzwilliam, N.H.

[73] Assignee: Peter C. Delaney, Keene, N.H.

[21] Appl. No.: 800,341

[22] Filed: Feb. 14, 1997

[51] Int. Cl.[6] ..... E04B 3/70; B27M 1/00

[52] U.S. Cl. ..... 52/455; 52/314; 52/315; 144/329; 144/332; 144/346; 144/355; 144/359

[58] Field of Search ..... 52/311, 314, 315, 52/313, 316; 144/329, 332, 358, 359, 363, 347, 355

[56] References Cited

U.S. PATENT DOCUMENTS 4,756,350 7/1988 Turner ..... 144/346

FOREIGN PATENT DOCUMENTS 1104669 2/1968 United Kingdom ..... 144/329

*Primary Examiner*—W. Donald Bray
*Attorney, Agent, or Firm*—George W. Dishong

[57] ABSTRACT

A process for cutting out decorative, artistic designs, and the three-dimensioned decorative and artistic products produced thereby which are incorporatable into articles of manufacture. The process creates relief designs by angle cutting, at predetermined and variable cut-angles and predetermined and variable cut-widths. The decorative cut-out piece, cut from a base piece, is one-directionally removable and one-directionally insertable into the aperture created when the piece is cut from the base piece. The cut-out piece inserts into the corresponding aperture a distance which is determined by a combination of cut-angle and cut-width. The maximum cut-angle and the maximum cut-width is limited by the thickness of the base piece. The cut width is substantially equal to the saw blade cut width or the width of the cut produced by any appropiate cutting device. The relief design for the three-dimensioned products is created by inserting the cut-out piece into the aperture and pushing it through the aperture until it binds. The cut-out piece forming the relief design protrudes from one surface of the base piece while it is recessed in the other surface of the base piece. The process may also be applied to articles where one or both surfaces are substantially planar, curved or actuate. The products may also be used with the decorative cut-out piece removed from the aperture, or inserted into the aperture such that the cut-out piece is flush with the surface of the base piece. The outline of the cut-out piece shows as an artistic design.

15 Claims, 4 Drawing Sheets

PROCESS FOR CUTTING OUT DECORATIVE/ARTISTIC DESIGNS AND PRODUCTS PRODUCED THEREBY

BACKGROUND OF THE INVENTION

1. Field of the Invention

This invention most generally relates to a process for creating decorative and artistic designs, and the products produced by such a process. More particularly this invention relates to angle-cutting out, at a predetermined cut-angle and predetermined cut-width, decorative and artistic designs in base pieces such as wood or plastic panels and inserting such designs into corresponding apertures created by the angle cut-out designs in such a manner as to create three dimensioned decorative and artistic products. Such products may be incorporatable into or may be articles of manufacture such as doors, shutters, wall panels, cabinetry, and artistic articles such as puzzles, murals or artwork. Most particularly this invention relates to a process for producing designs and patterns in three dimensioned products incorporatable into such articles of manufacture, which designs may be flush with the surface of the product or article, which may form raised relief patterns of uniform or differing relief, which may be completely removed, leaving apertures forming the designs, or which may form lowered or recessed relief patterns of uniform or differing relief.

2. Description of the Related Prior Art

The prior art addresses the general concept of creating designs on articles such as doors and cabinetry. The known prior art addresses articles formed from a core material overlaid with a veneer coating. Building paneling such as doors, shutters and cabinetry are typically formed from solid body such as a single piece of wood, or from a frame comprising vertical stiles and horizontal rails into which are inserted panels. In order to create pleasing designs on the two major surfaces of the paneling, decorative molding may be attached to, for example, the door. Or for those doors formed from a frame of vertical stiles and horizontal rails, the inserted panels may be of a different thickness than the material of the frame thus yielding a raised or lowered relief pattern for the door. However, this frame and panel type construction is costly due to the number of individual pieces requiring assembly. Other types of door panels, for example those used in bathroom and kitchen cabinetry, are formed from a single piece of hardboard such as Formica® brand of hardboard which comprise a core material covered with a hard plastic veneer. These materials present a smooth, hard surface which resists moisture and staining. Although functional, these types of materials are generally available only in flat, smooth stock with no decorative relief design. Designs may be cut into such materials, however this destroys the protective laminate coating at the sites of the cuts thus disturbing the uniform appearance of the article and the moisture resistance became the cut extends into the core material.

Although a conventional frame and panel door affords decorative relief designs, there are also undesirable aspects to the conventional frame and panel door. The use of stiles and rails with panels inserted, yields a weaker door than would be the case with a door made of a single piece of wood or laminated core material. The panels may be relatively easily broken out and over time the frame of stiles and rails may warp or sag. Thus it would be desirable to have panel products, such as doors, shutters and cabinetry, which are made from a single piece of material yet which also may be decorated with relief designs without compromising the strength, appearance or durability of the product.

Four U.S. patents are considered representative of the most relevant prior art creating relief designs in panel products. The four patents are U.S. Pat. Nos.: 4,008,551 to MacDonald et. al.; 4,097,100 to Sauder; 4,756,350 to Turner; and 5,095,675 to Audia.

The U.S. Pat. No. 4,008,551 to MacDonald et. al. discloses structural and decorative boards which are formed from a core material, laminated with a hard plastic veneer and given a relief appearance by forming a rabbeted groove, and mounting tapered, laminated strips in the groove. The shape of the groove is rectangular or square. The tapered strips are triangular in shape and have a thickness along one edge which corresponds to the depth of the groove and on which the other edge is narrow and is substantially flush with the base of the groove such that the strip covers the entire bottom surface of the groove. The panel is configured to have a relief pattern yet the exposed surfaces of the core material are still covered by the plastic veneer of the inserted laminated strip. In a variation, an angular groove may be cut, and simply covered by a thin strip of veneer to create the relief. The patent is directed towards a method of providing a relief surface in an initially smooth, flat panel made from a wood core and covered by a hard plastic veneer. The undercut groove described in this patent is cut at an angle with a width of about 1" at its base and about ⅞" at the groove opening. The groove is cut about ¼" deep, such that it penetrates the veneer and cuts into the core material. The purposes of the angled cut are: to provide a shadow effect which hides the exposed cut portion of the core of the panel, to create an illusion of a raised center panel, and to hold the insert strip in the groove.

U.S. Pat. No. 4,097,100 to Sauder is directed to "raised" or "lowered" panel assemblies such as those for doors and furniture, and utilizing composition or chip board core material and a thin layer of wood or plastic veneer. The panel assemblies of this patent are formed from a frame comprised of four pieces of molding assembled as vertical stiles and horizontal rails of, for example, a door and joined at mitered corners. The molding is rabbeted along the inner edge and receives a flat center panel formed with a projecting tongue or groove and lip to fit into the formed frame. The center panel may be of a thickness as to be in a raised or lowered relationship with the four-sided outer frame. This type of construction has been used for solid wood doors. However, with doors constructed of inexpensive core material overlaid with plastic or wood veneer layers, raised panel doors are costly and difficult to construct, because in order to cut relief patterns, the laminate has to be cut and the core exposed. The exposed core has a different appearance than the veneer and is also not moisture and stain resistant like the laminate. Making the appearance and other characteristics of the exposed core uniform with respect to the laminate is costly. This patent enables relief patterns to be constructed more quickly and less expensively because the center panel member creating the relief pattern is also made from a laminated core, but there is no cutting through the laminate involved. All the pieces are laminated and simply fit together in the desired relief pattern. The relief panel pieces are rectangular.

U.S. Pat. No. 4,756,350 to Turner discloses a method of making a panel-style door by forming elongate channels in a core panel, with each channel having a rectangular course and forming a rectangular region, creating the appearance of rectangular raised relief patterns. A veneer finish is applied over the rectangular regions and the surfaces of the channels. Inlay strips are then laid in the channels and a second layer of veneer is applied to cover the remaining portions of the exposed core panel and margins of the overlay strips. The inlay strips are like trim molding, and are flush with the surface of the panel and run along the edge of the channel to the floor of the channel (but not along the entire floor of the channel) and may be cut with various patterns to give design to the channel edge or side. The inlay strips cover the exposed, cut portion of the core panel. This application is primarily directed towards doors. In this method, the patterns and channels are cut in a solid panel of core material first, then a layer of veneer is applied, followed by by inlay strips and a second layer of veneer. The previous two references are directed towards creating patterns in material which already has a veneer coating, instead of creating the pattern first and then laminating.

Finally, U.S. Pat. No. 5,095,675 to Audia discloses a building panel, such as a door or wall panel into which relief patterns are formed. A groove of a predetermined shape, such as a square or rectangle, is cut in a solid, planar body, such as wood covered by a veneer layer. The groove has an open end and extends partially into the body. The groove may be of any size or shape. Decorative molding having a base fitting the shape and size of the entire groove is fixedly mounted in the groove. The molding may be simply flush with the groove or may have outwardly extending flanges which overlay the edges of the main panel body. The molding may be simple or formed with a design on its outer, exposed surface. The molding covers the entire surface of the groove, leaving no exposed cut in the core material and may be fixed in the groove with adhesive. This patent provides a decorative panel which is inexpensively and quickly constructed. The panel is decorative and may appear to give the illusion of raised or lowered relief patterns using the molding which may extend out beyond the main surface of the panel.

All of the references disclose methods of producing designs on articles, and all are directed to creating such designs on articles formed from a core material overlaid with veneer, as ways to maintain the look and protective coating of the veneer while producing a more visually pleasing surface. None however solves the problem of how to create genuine relief designs in solid wood articles. It would be desirable to be able to create genuine relief designs in solid wood articles as well as veneer coated composite material.

SUMMARY OF THE INVENTION

The present invention is most generally directed to a process for cutting out decorative, artistic designs, and the three-dimensioned decorative and artistic products produced thereby. The products are themselves useful but may also be incorporated into articles of manufacture such as for example, doors, door panels, shutters, shutter panels, cabinets, cabinet panels, drawers, drawer fronts, chests and cases, divider screens, divider screen panels and the like. Examples of three-dimensioned artistic products produced are such as: maps, puzzles, drawings, i.e., artworks, murals, wall decorations, and the like. Further three dimensioned artistic designs or products may be produced on such things a violins, violas and other music instruments. The process creates three dimensioned or relief designs on the products and/or articles by angle cutting, at a predetermined and variable cut-angle and a predetermined and variable cut-width, decorative cut-out pieces from a base piece having a first and a second surface such that each decorative cut-out piece is one-directionally removable and one-directionally insertable into the resulting corresponding aperture created when the decorative cut-out piece is cut from the base piece. The cut-out piece inserts into the corresponding aperture by an insertion amount or insertion distance which is determined by either the cut-angle, the cut-width or by a combination of both. The maximum cut-angle and the maximum cut-width is limited by the thickness dimension of the base piece. The base piece may be formed from many suitable materials such as for example, wood, metals, fiberboard, plastics etc . . . The relief design for the three-dimensioned products is created by inserting the decorative cut-out piece into the corresponding aperture and pushing it through the aperture until it binds in the aperture, wherein the decorative cut-out piece forming the relief design protrudes from one surface of the base piece while it is recessed in the other surface of the base piece. The protrusion distance and the recessed distance being the insertion distance which, in turn, is determined by the chosen cut-angle and the chosen cut-width. The process may also be applied to articles on which one or both surfaces are substantially planar, curved or arctuate. The products may also be used with the decorative cut-out piece completely removed from the corresponding aperture, or with the decorative cut-out piece inserted into the corresponding aperture such that the decorative cut-out piece is flush with both surfaces of the base piece showing thereby the outline of the decorative cut out piece as the artistic design.

The present invention more particularly provides the above process for creating panel products, preferably made of non-hollow wood or plastic, having relief designs created therein.

Thus it is an object of the present invention to provide a method of producing panel products having genuine raised and/or lowered relief designs and such panel products produced thereby.

It is also an object of the invention to produce panel products which may have various levels of relief design.

It is a primary object of the invention to provide a process for making a three dimensioned decorative, artistic design product incorporatable into an article of manufacture, comprising the steps of: fabricating a base piece having, a perimeter edge thereof, a first surface and a second surface, the first and second surfaces being separated by a thickness dimension of the base piece; determining a maximum cut-angle and a maximum cut-width based upon the thickness dimension of the base piece; determining a cut-angle and a cut-width based upon, a desired protrusion distance of each of the decorative cut-out pieces to be cut from the base piece; angle cutting, at the determined cut-angle and cut-width, the base piece from the first surface to the second surface in at least one predetermined and continuous pattern, thereby forming each one of the decorative cut-out pieces, each decorative cut-out piece being thereby one-directionally removable from the base piece thereby creating a corresponding decorative aperture for each of the decorative cut-out pieces in the base piece upon removal of the decorative cut-out piece from the base piece; and inserting, by an insertion distance, at least one of the decorative cut-out pieces into the corresponding decorative aperture by the desired protrusion distance thereby forming the three dimensioned decorative, artistic design incorporatable into the article of manufacture.

It is another primary object of the invention to provide the process as above described where the first and second surfaces may be substantially planar however, the surfaces may also be arcuate.

It is yet another primary object of the invention to provide the process as above described further comprising the step of removing at least one of the decorative cut-out pieces from the corresponding aperture in the base piece thereby creating the three dimensioned decorative, artistic design having at least one corresponding aperture therethrough as a part of the three dimensioned decorative, artistic design.

It is still yet another primary object of the invention to provide the process as above described further comprising the step of pushing at least one of the decorative cut-out pieces through the corresponding aperture until it binds within the corresponding aperture.

It is still yet another primary object of the invention to provide the process as above described further comprising the step of flush attaching, within the corresponding aperture, at least one of the decorative cut-out pieces flush with the first and the second surfaces creating thereby at least one outline design of the flush attached decorative cut-out piece on the first and second surfaces of the base piece.

It a basic object of the invention to provide a three-dimensioned decorative, artistic article of manufacture produced by a process steps described above wherein the article of manufacture is selected from the group consisting of doors, door panels, shutters, shutter panels, cabinets, cabinet panels, drawers, drawer fronts, chests and cases, divider screens, divider screen panels, furniture, maps, puzzles, drawings, artworks, murals and wall decorations.

It another basic object of the invention to provide a three-dimensioned decorative, artistic design product incorporatable into an article of manufacture comprising: a base piece having a perimeter edge thereof, a first surface and a second surface, the first and the second surface being separated by a thickness dimension of the base piece; at least one decorative cut-out piece one-directionally removable from the base piece wherein each one of the decorative cut-out pieces is formed by angle cutting at a predetermined cut-angle and a predetermined cut-width, the base piece in at least one predetermined and continuous pattern thereby forming the decorative cut-out piece. The cut width is the dimension substantially equal to the saw blade cut width or the width of the cut produced by any cutting means such as a laser cutter. The cut-angle and the cut-width are based upon, a desired protrusion distance of each of the decorative cut-out pieces, and each of the decorative cut-out pieces being thereby one-directionally removable from the base piece thereby creating a corresponding decorative aperture for each decorative cut-out piece in the base piece upon removal of the decorative cut-out piece from the base piece; and each of the decorative cut-out pieces insertable into the corresponding decorative aperture by an insertable distance. The desired protrusion distance is thereby formed and the three dimensioned decorative, artistic design is thus incorporatable into the article of manufacture such as doors, door panels, shutters, shutter panels, cabinets, cabinet panels, drawers, drawer fronts, chests and cases, divider screens, divider screen panels, furniture, maps, puzzles, drawings, artworks, murals and wall decorations.

It another basic object of the invention to provide a three-dimensioned decorative, artistic design product incorporatable into an article of manufacture wherein the first and second surfaces are substantially parallel each to the other but also may each be arcuate.

It another basic object of the invention to provide a three-dimensioned decorative, artistic design product incorporatable into an article of manufacture wherein each of the decorative cut-out piece is removed from the base piece thereby creating the three dimensioned decorative, artistic design having the corresponding aperture therethrough as a part of the three dimensioned decorative, artistic design. The decorative cut-out piece may also be pushed through the corresponding aperture until each of the chosen decorative cut-out pieces binds within the corresponding aperture. The decorative cut-out piece may also be flush attached, within the corresponding aperture. The decorative cut-out piece so attached will be flush with both the first and second surfaces creating thereby at least one outline design on the first and the second surfaces of the base piece.

These and further objects of the present invention will become apparent to those skilled in the art to which this invention pertains after a study of the present disclosure of the invention.

DESCRIPTION OF THE PREFERRED EMBODIMENTS

The present invention is directed to a process for cutting out decorative, artistic designs, and the products produced thereby.

Figure 1A:
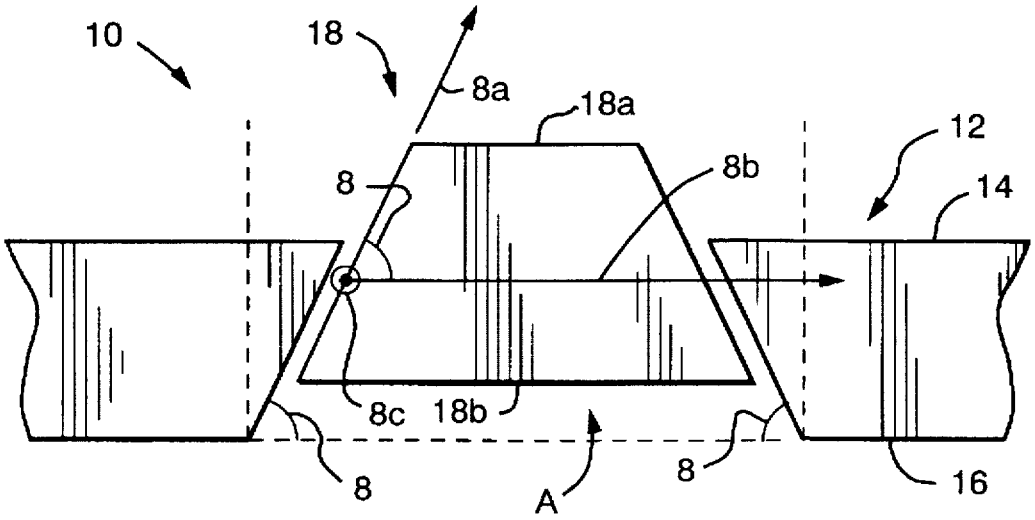
FIG. 1A is a perspective cut away view of the product illustrating the cut-angle, cut-width and the rays which define the cut-angle.
Figure 1B:
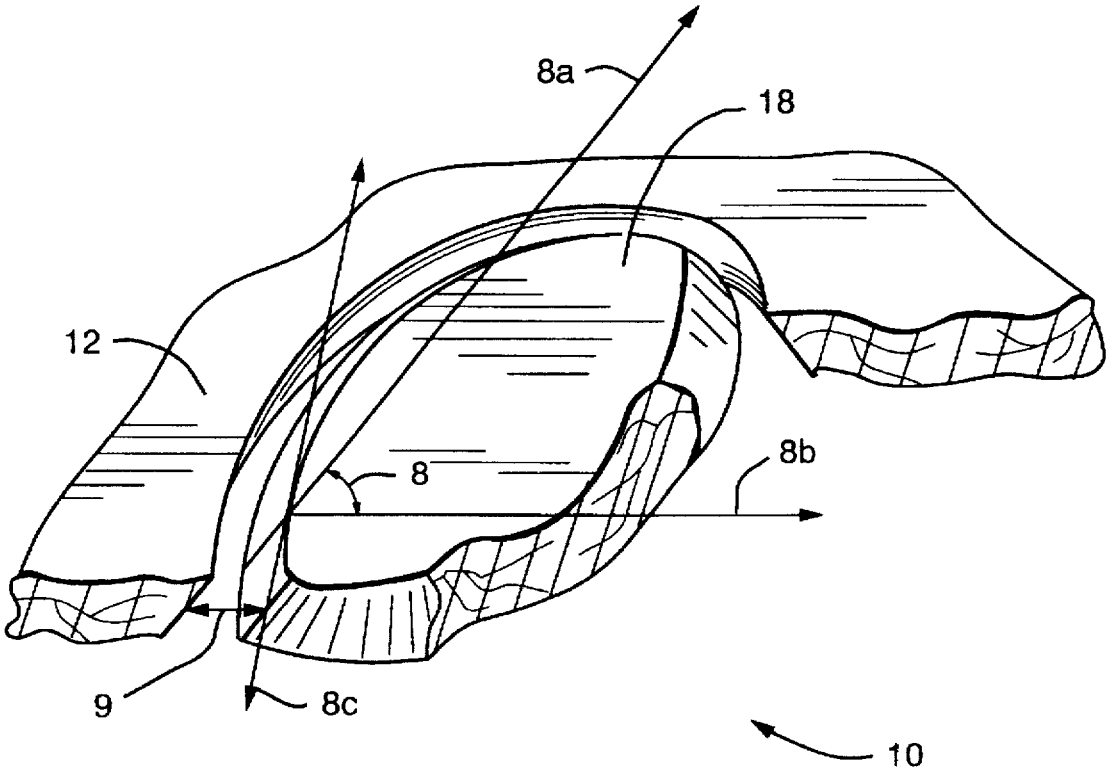
FIG. 1 is an exploded cross-sectional view showing the cut-angle and the one-directional insertability of the cut-out pieces.

Referring now in detail to the drawings, wherein similar reference numerals denote similar elements throughout the drawings, the process and the product 10 of the present invention, as shown in FIGS. 1 and 1A comprises a process of cutting a decorative cut-out piece, represented generically by numeral 18, from a base piece 12 which has a perimeter, a first surface 14 and a second, opposing surface 16, angle-cutting at a cut-angle 8 formed by rays 8*a* and 8*b* and a cut-width 9 such that decorative cut-out piece 18 is one-directionally insertable into, and one-directionally removable from, the resulting, corresponding aperture A in base piece 12. Decorative cut-out piece 18 has a first cut-out surface 18*a* and a second cut-out surface 18*b*. First cut-out surface 18*a* is of a smaller area dimension than the area dimension of second cut-out surface 18b such that decorative cut-out piece 18 may be inserted into and removed from aperture A in base piece 12 in one direction only. Decorative cut-out piece 18 may be inserted into aperture A such that decorative cut-out piece 18 extends partially through aperture A until decorative cut-out piece 18 binds and is secured within aperture A extending partially therethrough thereby creating three-dimensioned product 10—in this instance a raised relief design on first surface 14 and a lowered or recessed relief design in second surface 16. Multiple decorative cut-out pieces 18 may be cut from base piece 12. Multiple decorative cut-out pieces (shown as 38a–h in FIG. 3) may be cut such that combinations of both raised and recessed relief designs are formed on both surfaces 14 and 16 of base piece 12 creating thereby a variety of product generally identified by numeral 10. First and second surfaces 14 and 16 may both be substantially planar and parallel. Also, one surface, for example first surface 14, may be curved or arctuate, while second surface 16 may be substantially flat, or first surface 14 may be substantially flat while second surface 16 may be curved or arcuate, or both surfaces 14 and 16 may be curved or arctuate.

Cut-angle 8 and cut-width 9 varies depending on the desired size and amount of protrusion of decorative cut-out pieces 18 and the thickness of base piece 12. Preferably cut angle 8 is between about 80° and about 88° but may have a minimum and a maximum value which is clearly a function of the cut-width and the thickness of base piece 12 and the desired amount of protrusion of pieces 18. Cut angle 8 is measured between a first ray 8a which is substantially coincident with or parallel to the cut surface of the particular decorative cut-out piece or the cut surface of the corresponding aperture and directed perpendicular to a tangent line 8c lying in the plane of base piece 12 and tangent to either the cut surface of the particular decorative cut-out piece 18 or the cut surface corresponding aperture and a second ray 8b lying in the plane of the base piece 12 and extending perpendicularly to the tangent line 8c. The amount of protrusion of decorative cut-out piece 18 through aperture A depends upon cut-width 9 and cut-angle 8. The cut-width 9 is the dimension substantially equal to the saw blade cut width or the width of the cut produced by any cutting means such as a laser cutter which may be programmable as to the beam width and therefor the cut width. The maximum amount of protrusion is also a function of the thickness of base piece 12. The products may also be used with decorative cut-out piece 18 completely removed from aperture A, or with decorative cut-out piece 18 inserted into aperture A such that decorative cut-out piece 18 is flush with both surfaces 14 and 16 of base piece 12 showing thereby the outline of decorative cut-out piece 18 as the design.

Figure 2B:
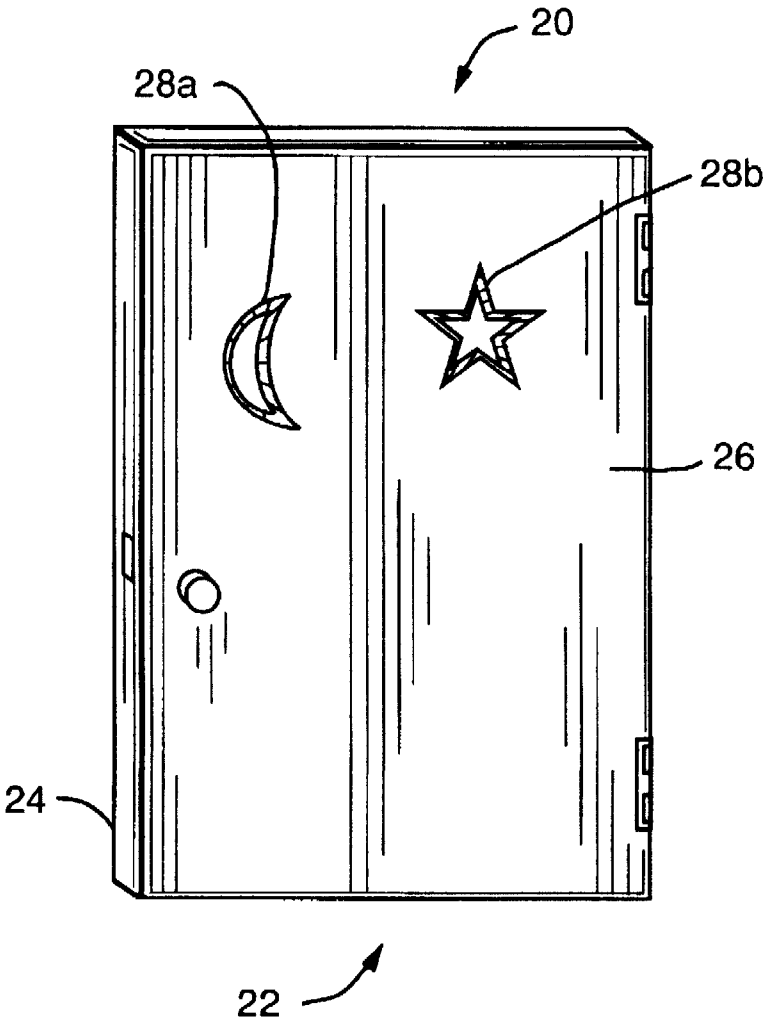
FIG. 2B is a perspective view of the door of FIG. 2A from the opposing side, and having a lowered or recessed relief design.
Figure 2A:
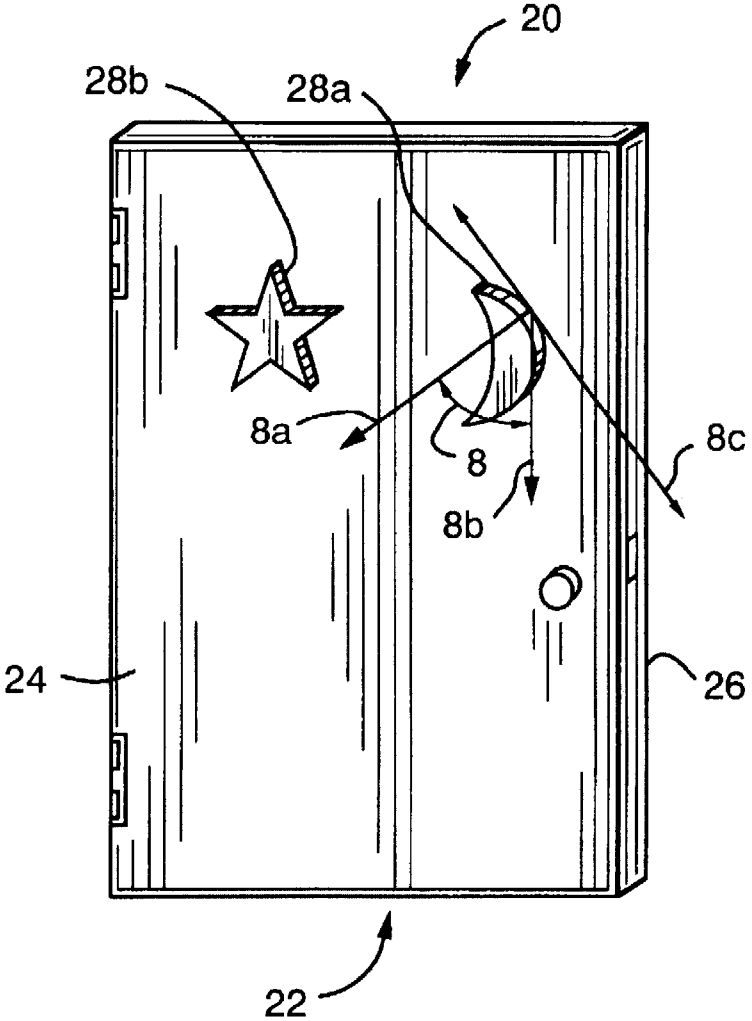
FIG. 2A is a perspective view of one side of a door produced by the process of the present invention and having raised relief design.

FIG. 2A illustrates an embodiment of the present invention producing a door 20 as the article of manufacture. It should be noted that products 10 may in themselves be articles such as a door and the like or the products 10 may be incorporatable into doors as door panels and thereby resulting in the articles of manufacture such as cabinet 50 shown in FIG. 5. Various decorative cut-out pieces, specifically represented as 28a, and 28b are cut out of base piece 22. Decorative cut-out pieces 28a and 28b protrude from first surface 24 of base piece 22 thereby creating a raised relief design on first surface 24, and a lowered or recessed design in second surface 26, although second surface 26 can not be seen in FIG. 2A. FIG. 2B illustrates the door 20 of FIG. 2A as seen from second surface 26 having a lowered or recessed relief design.

Figure 3A:
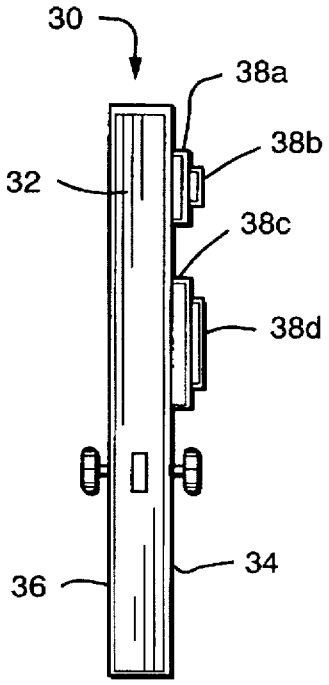
FIG. 3A is a side view of a door produced by the process of the present invention and having differing layers or levels of relief design, all raised relief designs facing the same side of the door.
Figure 3B:
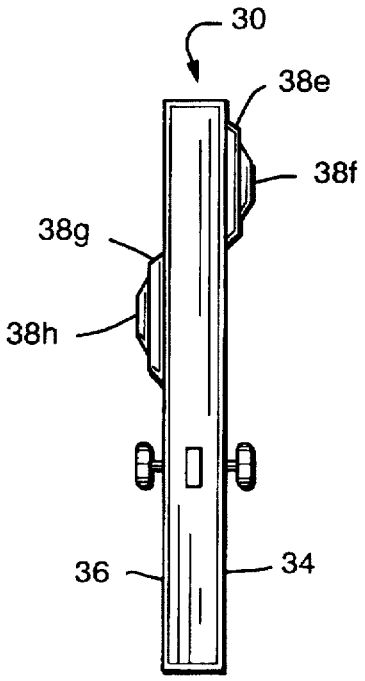
FIG. 3B is a side view of a door produced by the process of the present invention and having differing layers or levels of relief design, with some raised relief designs and some lowered relief designs on each side of the door.

FIGS. 3A and 3B show an embodiment of a door 30 having multiple levels or steps of decorative cut-out pieces 38a–38h cut out of base piece 32 thereby creating various multi-level or multi-step raised and lowered or recessed relief designs on first surface 34a, and multi-level raised and lowered or recessed relief designs in second surface 36a.

Figure 4:
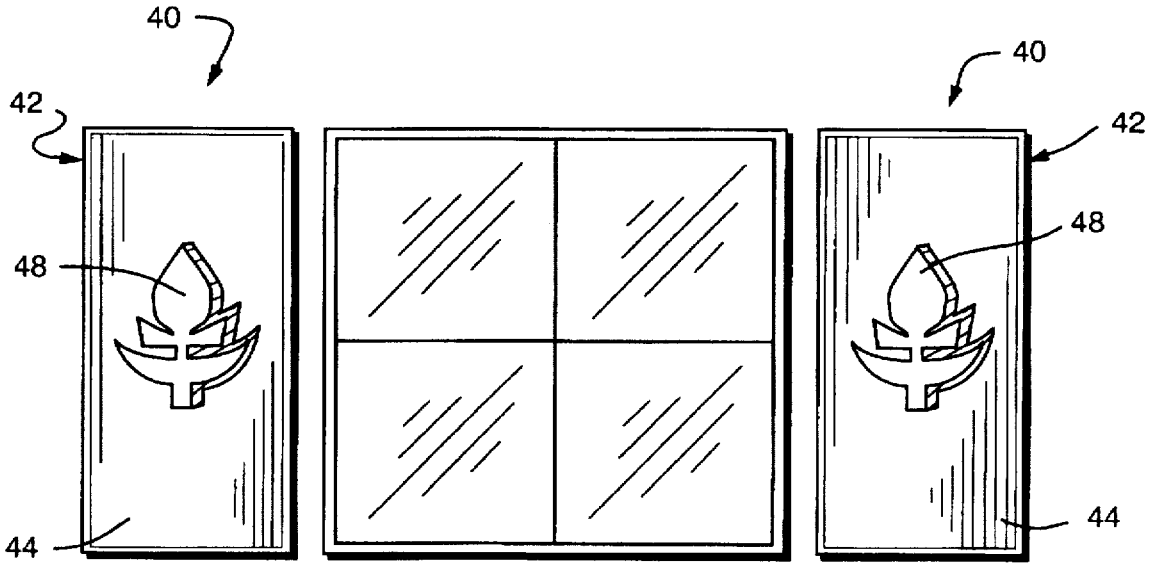
FIG. 4 is a perspective view of shutters produced by the process of the present invention and having raised relief design.

FIG. 4 illustrates the product produced when the process is used on shutters 40. Decorative cut-out pieces 48 are cut from base piece 42 and pushed through the corresponding apertures to protrude from first surface 44 thereby creating a raised relief design on first surface 44.

Figure 5:
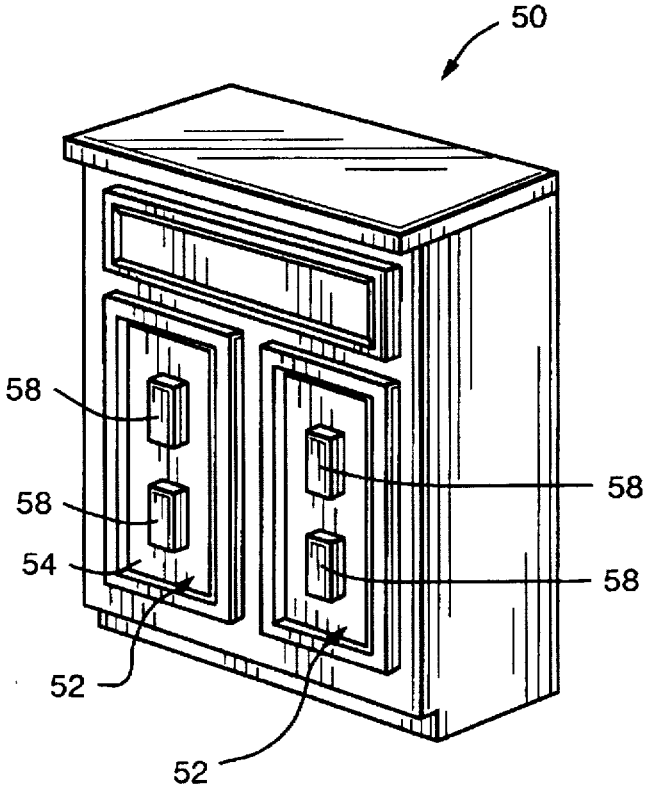
FIG. 5 is a perspective view of cabinetry doors produced by the process of the present invention and having raised relief design.

FIG. 5 shows the product produced by the process of the present invention when applied to cabinetry 50. Decorative cut-out pieces 58 are cut from base piece 52 and protrude from first surface 54 through the corresponding apertures.

Figure 6:
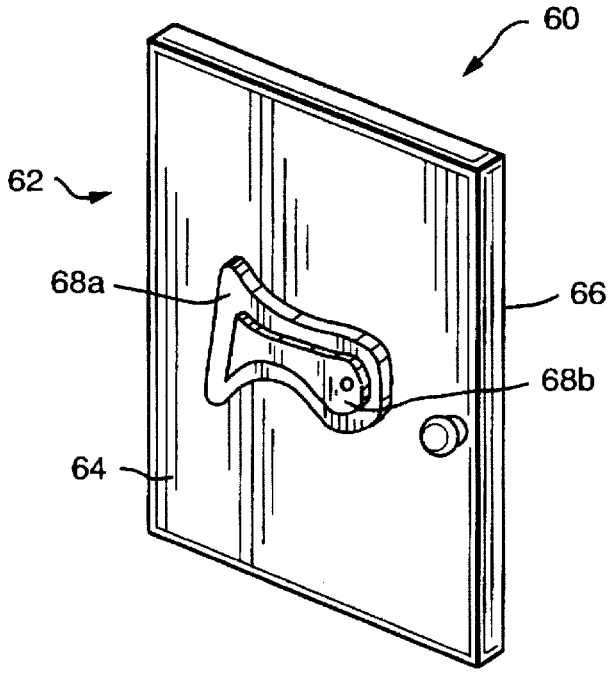
FIG. 6 is a perspective view of a cabinet door produced by the process of the present invention and having a multi-level raised relief design.

FIG. 6 further illustrates a cabinetry product 60 produced by the process of the present invention wherein multiple decorative cut-out pieces 68a, 68b are cut from base piece 62 and pushed through the corresponding apertures to protrude from first surface 64 thereby creating a multi-level raised relief design on first surface 64, and, although not shown, a multi-level lowered or recessed relief design in second surface 66.

The three-dimensioned decorative, artistic design product, created by the process of the invention and incorporatable into an article of manufacture, is generally denoted by numeral 10. The article of manufacture produced by the process of the invention may be, by way of non-limiting example, doors, door panels, shutters, shutter panels, cabinets, cabinet panels, drawers, drawer fronts, chests and cases, divider screens, divider screen panels, furniture and the like. Examples of three-dimensioned artistic products produced are such as: maps, puzzles, drawings, i.e., artworks, murals, wall decorations, and the like. The three dimensioned products could also be articles having curved or arctuate surfaces such as the surfaces of a decorative stringed instrument such as a violin or viola. The products 10 produced by the process described may be produced from base pieces formed from many suitable materials such as for example, wood, metals, fiberboard, plastics etc . . . The base pieces may be solid material or may be formed from a core material covered or laminated with a thin coating of wood or plastic veneer, from edge-glued wood panels, or from plastic. The products 10 may also be produced from a core material and then laminated after all cutting has been done such that no core material remains exposed. The process may also be applied to articles made from multiple pieces such as doors having a perimeter frame made of vertical stiles and horizontal rails into which solid or edge-glued door panels are inserted. The door panels may be cut with various types of relief designs according to the process of the present invention and then inserted into the frame.

The process of the present invention could also be used to form masters for vacuum form molds used to make plastic relief panels, using both raised and recessed forms of the product of the present invention.

It is thought that the present invention, the process for cutting out decorative/artistic designs and products produced thereby, and many of its attendant advantages is understood from the foregoing description. Clearly, the variety of designs and artforms and products is substantially unlimited. The choice of materials is very broad. The application of the process of this invention to artforms, to material forming technology is apparent and it will be further apparent that various changes may be made in the forms, sizes, construction and arrangement of the parts thereof without departing from the spirit and scope of the invention or sacrificing its material advantages, the form herein before described being merely a preferred or exemplary embodiment thereof.

We claim:

1. A process for making a three dimensioned decorative, artistic design incorporatable into an article of manufacture, comprising the steps of:

fabricating a base piece having, a perimeter edge thereof, a first surface and a second surface, said first and said second surface separated by a thickness dimension of said base piece;

determining a maximum cut-angle and a maximum cut-width based upon said thickness dimension of said base piece;

determining a cut-angle and a cut-width based upon, a desired protrusion distance of each of at least one decorative cut-out piece to be cut from said base piece;

angle cutting, at said determined cut-angle and cut-width, said base piece in at least one predetermined and continuous pattern, thereby forming each said at least one decorative cut-out piece, each said at least one decorative cut-out piece being thereby one-directionally removable from said base piece thereby creating a corresponding decorative aperture for each said at least one decorative cut-out piece in said base piece upon removal of each said decorative cut-out piece from said base piece; and inserting an insertion distance, at least one of each said decorative cut-out piece into at least one each said corresponding decorative aperture said desired protrusion distance thereby forming said three dimensioned decorative, artistic design incorporatable into said article of manufacture.

2. The process for making a three dimensioned decorative, artistic design incorporatable into an article of manufacture according to claim 1 wherein said first and said second surfaces are substantially parallel each to the other.

3. The process for making a three dimensioned decorative, artistic design incorporatable into an article of manufacture according to claim 1 further comprising the steps of:

removing at least one of each said decorative cut-out piece from said base piece corresponding aperture thereby creating said three dimensioned decorative, artistic design having said corresponding aperture therethrough as a part of said three dimensioned decorative, artistic design.

4. The process for making a three dimensioned decorative, artistic design incorporatable into an article of manufacture according to claim 1 further comprising the steps of:

pushing at least one of each said decorative cut-out piece through said corresponding aperture until each said at least one decorative cut-out piece binds within said corresponding aperture.

5. The process for making a three dimensioned decorative, artistic design incorporatable into an article of manufacture according to claim 1 further comprising the steps of:

flush attaching, within said corresponding aperture, at least one of each said decorative cut-out piece flush with said first and said second surfaces creating thereby at least one outline design of said at least one flush attached decorative cut-out piece on said first and said second surfaces of said base piece.

6. A three-dimensioned decorative, artistic article of manufacture produced by a process comprising the steps of:

fabricating a base piece having, a perimeter edge thereof, a first surface and a second surface, said first and said second surface separated by a thickness dimension of said base piece;

determining a maximum cut-angle and a maximum cut-width based upon said thickness dimension of said base piece;

determining a cut-angle and a cut-width based upon, a desired protrusion distance of each of at least one decorative cut-out piece to be cut from said base piece;

angle cutting, at said determined cut-angle and cut-width, said base piece in at least one predetermined and continuous pattern, thereby forming each said at least one decorative cut-out piece, each said at least one decorative cut-out piece being thereby one-directionally removable from said base piece thereby creating a corresponding decorative aperture for each said at least one decorative cut-out piece in said base piece upon removal of each said decorative cut-out piece from said base piece; and inserting an insertion distance, at least one of each said decorative cut-out piece into at least one each said corresponding decorative aperture said desired protrusion distance thereby forming said three dimensioned decorative, artistic design incorporatable into said article of manufacture;

wherein said article of manufacture is selected from the group consisting of doors, door panels, shutters, shutter panels, cabinets, cabinet panels, drawers, drawer fronts, chests and cases, divider screens, divider screen panels, maps, puzzles, drawings, artworks, murals and wall decorations.

7. The article of manufacture produced by the process according to claim 6 further comprising the step of:

removing at least one of each said decorative cut-out piece from said base piece corresponding aperture thereby creating said three dimensioned decorative, artistic design having said corresponding aperture therethrough as a part of said three dimensioned decorative, artistic design.

8. The article of manufacture produced by the process according to claim 6 further comprising the steps of:

pushing at least one of each said decorative cut-out piece through said corresponding aperture until each said at least one decorative cut-out piece binds within said corresponding aperture.

9. The article of manufacture produced by the process according to claim 6 further comprising the steps of:

flush attaching, within said corresponding aperture, at least one of each said decorative cut-out piece flush with said first and said second surfaces creating thereby at least one outline design of said at least one flush attached decorative cut-out piece on said first and said second surfaces of said base piece.

10. A three dimensioned decorative, artistic design incorporatable into an article of manufacture comprising:

a base piece having a perimeter edge thereof, a first surface and a second surface, said first and said second surface separated by a thickness dimension of said base piece;

at least one decorative cut-out piece one-directionally removable from said base piece wherein each said decorative cut-out piece is formed by angle cutting at a predetermined cut-angle and a predetermined cut-width, said base piece in at least one predetermined and continuous pattern thereby forming each said at least one decorative cut-out piece, said cut-angle and said cut-width based upon, a desired protrusion distance of each of said at least one decorative cut-out piece, each said at least one decorative cut-out piece being thereby one-directionally removable from said base piece thereby creating a corresponding decorative aperture for each said at least one decorative cut-out piece in said base piece upon removal of each said decorative cut-out piece from said base piece; and each of said at least one decorative cut-out piece insertable into said corresponding decorative aperture by an insertable distance, said desired protrusion distance thereby forming said three dimensioned decorative, artistic design incorporatable into said article of manufacture.

11. The three dimensioned decorative, artistic design incorporatable into an article of manufacture according to claim 10 wherein said first and said second surfaces are substantially parallel each to the other.

12. The three dimensioned decorative, artistic design incorporatable into an article of manufacture according to claim 10 wherein each said decorative cut-out piece is removed from said base piece thereby creating said three dimensioned decorative, artistic design having said corresponding aperture therethrough as a part of said three dimensioned decorative, artistic design.

13. The three dimensioned decorative, artistic design incorporatable into an article of manufacture according to claim 10 wherein at least one of each said decorative cut-out piece is pushed through said corresponding aperture until each said at least one decorative cut-out piece binds within said corresponding aperture.

14. The three dimensioned decorative, artistic design incorporatable into an article of manufacture according to claim 10 wherein at least one of each said decorative cut-out piece is flush attached, within said corresponding aperture, said decorative cut-out piece attached flush with said first and said second surfaces creating thereby at least one outline design of said at least one flush attached decorative cut-out piece on said first and said second surfaces of said base piece.

15. The three dimensioned decorative, artistic design incorporatable into an article of manufacture according to claim 10 wherein said article of manufacture is selected from the group consisting of doors, door panels, shutters, shutter panels, cabinets, cabinet panels, drawers, drawer fronts, chests and cases, divider screens, divider screen panels, maps, puzzles, drawings, artworks, murals and wall decorations.

* * * * *